United States Patent [19]

Jacobson et al.

[11] 4,097,736

[45] Jun. 27, 1978

[54] RADIATION ENERGY CALIBRATING DEVICE AND METHOD

[75] Inventors: Arnold Frederick Jacobson, Madison, Wis.; James Oliver Pazaris, Chicago, Ill.

[73] Assignee: Radnovation, Incorporated, Madison, Wis.

[21] Appl. No.: 767,987

[22] Filed: Feb. 14, 1977

[51] Int. Cl.[2] ..... G12B 13/00; H05G 1/26

[52] U.S. Cl. ..... 250/252; 250/401

[58] Field of Search ..... 250/252, 358 R, 401, 250/402

[56] References Cited

U.S. PATENT DOCUMENTS

| | | | |
|---|---|---|---|
| 2,539,203 | 1/1951 | Pohl | 250/402 X |
| 2,985,761 | 5/1961 | Ohmart | 250/401 |
| 3,766,383 | 10/1973 | Harris et al. | 250/252 |
| 3,955,086 | 5/1976 | Tsujii et al. | 250/358 R |

*Primary Examiner*—Alfred E. Smith
*Assistant Examiner*—Janice A. Howell
*Attorney, Agent, or Firm*—Alter and Weiss

[57] ABSTRACT

A radiation energy calibrating device and method which uses measurements of radiation intensity from x-ray tubes to determine the peak voltages across the tubes. The device includes radiation energy absorbers placed between the radiation detectors and the x-ray source. The detectors convert the radiation energy to electrical signals. Electronic circuitry determines the signal peaks and uses the signal peaks either to automatically provide a readout of the peak kilovolts or to provide a reading to enable table-assisted conversion to peak KV.

12 Claims, 6 Drawing Figures

RADIATION ENERGY CALIBRATING DEVICE AND METHOD

This invention is concerned with the calibration of the energy of radiation from a given source, such as an x-ray tube; and more particularly, with determining the peak input kilovoltage to a radiation source from measurements of the radiation it emits.

The precise calibration of the x-ray generator is important in diagnostic radiology. For example, it is necessary to know the peak tube potential or peak kilovoltage (kVp) of diagnostic x-ray machines. To further the example, in mammography, detection of punctate calsification and fine soft tissue structures is accomplished with low energy radiation; i.e., produced at voltages below 50 kVp. To minimize patient dose and maximize image quality, the setting of the kVp must be accurate. In practice, both image contrast and film density depend on maintaining accurate kilovoltage readings in the range below 50 kVp.

Precise calibration is also required in conventional radiography where it is often convenient, and in fact, necessary to match techniques in different x-ray departments or even in the same department using different x-ray machines. Therefore, it is necessary to know the actual radiation quality of the x-ray beams of the different machines, and this requires knowledge of kVp.

When a voltage V is applied across an energized x-ray tube, a continuous distribution (spectrum) of x-rays with energies ranging from O to V electron-volts is produced. The exact shape of this distribution depends only on the amount and composition of any radiation absorbers (filters) between the x-ray source (anode) and the point of measurement.

In almost all medical diagnostic x-ray machines, the voltage applied to the x-ray tube varies with time, as does the current flowing through it. Thus, the x-ray spectrum produced also varies with time. Nevertheless, it is universal practice for the voltage setting on an x-ray generator to correspond to the maximum tube voltage reached during the interval of x-ray production, the so-called peak kilovoltage or kVp. This is done because the kVp is related to the peak value of the line voltage, which is typically pulsating, via the turns ratio of the high voltage transformer. Also, since the kVp is equal to the highest x-ray photon energy in KeV, it bears a relationship to the penetrating power of the x-ray beam, and hence is used as a specification for individual radiographic procedures. While it can be and often has been argued that the kVp is not sufficient by itself for this latter function, x-ray equipment continues to specify the applied voltage in terms of the kVp. Therefore, methods for determining the kVp are needed to assure that the x-ray equipment is properly calibrated.

The only direct technique for determining the peak kilovoltage is through the insertion of a voltage divider into the high voltage circuit. Through the use of an oscilloscope or a peak reading voltmeter, it is possible to obtain accurate measurement of the kVp. This method is best suited as a reference standard, since the time required, the complexity of the apparatus, the skill required of the user, and the shock hazard, make it inappropriate for routine use.

One group of indirect techniques determines the kVp by measuring the maximum x-ray energy in the x-ray beam, the correspondence between kVp and KeV maximum previously having been noted. The more accurate techniques employ an x-ray spectrometer, which measures the actual x-ray energy spectrum and, hence, KeV maximum. While these techniques do not have the shock hazards of the voltage divider method, they do have all the other drawbacks, long times required, complicated apparatus, considerable user technical skill, and some interpretation problems.

Other techniques attempt to correlate the maximum x-ray energy with sharp changes in radiation absorption which occur at well-known energies for different materials. These approaches require elaborate physical setups, many different absorbers, considerable time and interpretation, and have neither the accuracy nor ease needed for routine use.

There is a broad group of techniques which are totally inferential, and usually empirical as well. They employ measurements of the radiation intensity penetrating different thicknesses of a radiation absorber, and then either attempt to reconstruct the shape of the original x-ray energy spectrum, or use comparison techniques where relationships with electrically measured voltages have previously been determined. Because these techniques integrate the radiation produced at all tube voltages, it is often difficult to correlate results with the kVp. The accuracy of these methods depends entirely on matching the voltage waveforms of the unit under test and the reference machine on which calibration data were taken. While there are available simple devices employing these methods, consistent accuracy for all types of x-ray machines is not possible. See "Test Cassette for Measuring Peak Tube Potential of Diagnostic X-Ray Machines", by A. F. Jacobson, J. R. Cameron, M. P. Sieband, J. Wagner, (P.19), Medical Physics, Vol. 3 No. 1 — Jan/Feb — 1976.

The profession is still in need of a calibration technique for field usage which can be used by the ordinary technician with speed and precision.

Accordingly, an object of the present invention is to provide new and unique devices for measuring the maximum energy or the peak voltage applied to the radiation source.

A related object of the present invention is to provide devices for calibrating x-ray equipment in the field by taking measurement when peak voltages are applied to the source.

Yet another related object of the present invention is to provide a method of determining the peak kilovoltage applied to the radiation source and making this determination by measurements of the peak energy of the radiation.

Still a further object of the present invention is to provide radiation energy calibration equipment which automatically detects the peak intensity of the radiation produced during the varying voltage input to the source and reads out the peak kilovoltage directly or provides a readout that can be readily used with a chart to determine the actual maximum radiation energy and hence the kVp.

Yet another object of the present invention is to calibrate the kVp indication of the radiation source by detecting the peak radiation intensity passing through absorbers of varying thickness, and comparing the detected peaks with references.

The maximum radiation intensity produced by an x-ray tube occurs at the peak tube potential. This is so for two reasons: (1) efficiency of x-ray production increases with increasing tube potential; (2) the tube current at the kVp is also at its maximum value. The device herein described employs only measurements made at the instant of peak radiation intensity. The measured values thus are characteristic of only the radiation energy spectrum produced at the kVp, and are analogous to measurements made on an x-ray tube operated at a constant potential. As the spectral distribution depends, in practice, only on the tube voltage and the absorbers present, use of the peak measurement eliminates the effect of the variation in voltage waveform from one x-ray machine to another, leaving only the effect of different amounts and types of absorber. This effect, however, can be minimized by introducing into the beam a thickness of absorbing material which produces an absorption far greater than that of the absorbers already present in a machine. For example, two machines having relative inherent absorptions of 1 and 3 arbitrary units will differ by 200%, but following addition of 100 units of absorber, they will differ by only 2%. Thus, the added 100 units will make the x-ray energy distributions of the two machines equivalent to within 2%.

Through the use of peak intensity measurements of the radiation beam transmitted through a suitably thick radiation absorber, the variability between different machines produced by the tube voltage and tube current waveforms and the inherent filtrations, is effectively eliminated. Thus, any constant potential x-ray unit provided with the thick added filter can be used to calibrate and provide empirical reference data for the device. Any characteristic of the beam produced by the constant potential unit can be used to infer the kVp: e.g., the shape of the attenuation curve, the intensity ratio between two absorber thicknesses, and the absorber thickness required to reduce a reference intensity by a fixed fraction. Whatever method is used, the device will have high accuracy, since one calibration relation will apply to all machines which might be tested. The device thus will be well suited for routine equipment calibration.

In a preferred embodiment of the invention a plurality of detectors are used with absorbers of varying thickness to detect the radiation emanating from the source. The peak signal from each detector is determined. This can either be the highest peak signal or a peak obtained by signal averaging. The peak information is used to obtain the peak kilovoltage applied to the radiation source.

The equipment and method enable laboratory technicians to accurately calibrate diagnostic x-ray machines within a short period of time and in a safe, repeatable, and efficient manner.

These and other objects and features of the invention will be best understood when taken in conjunction with the accompanying drawings, in which.

Figure 1:
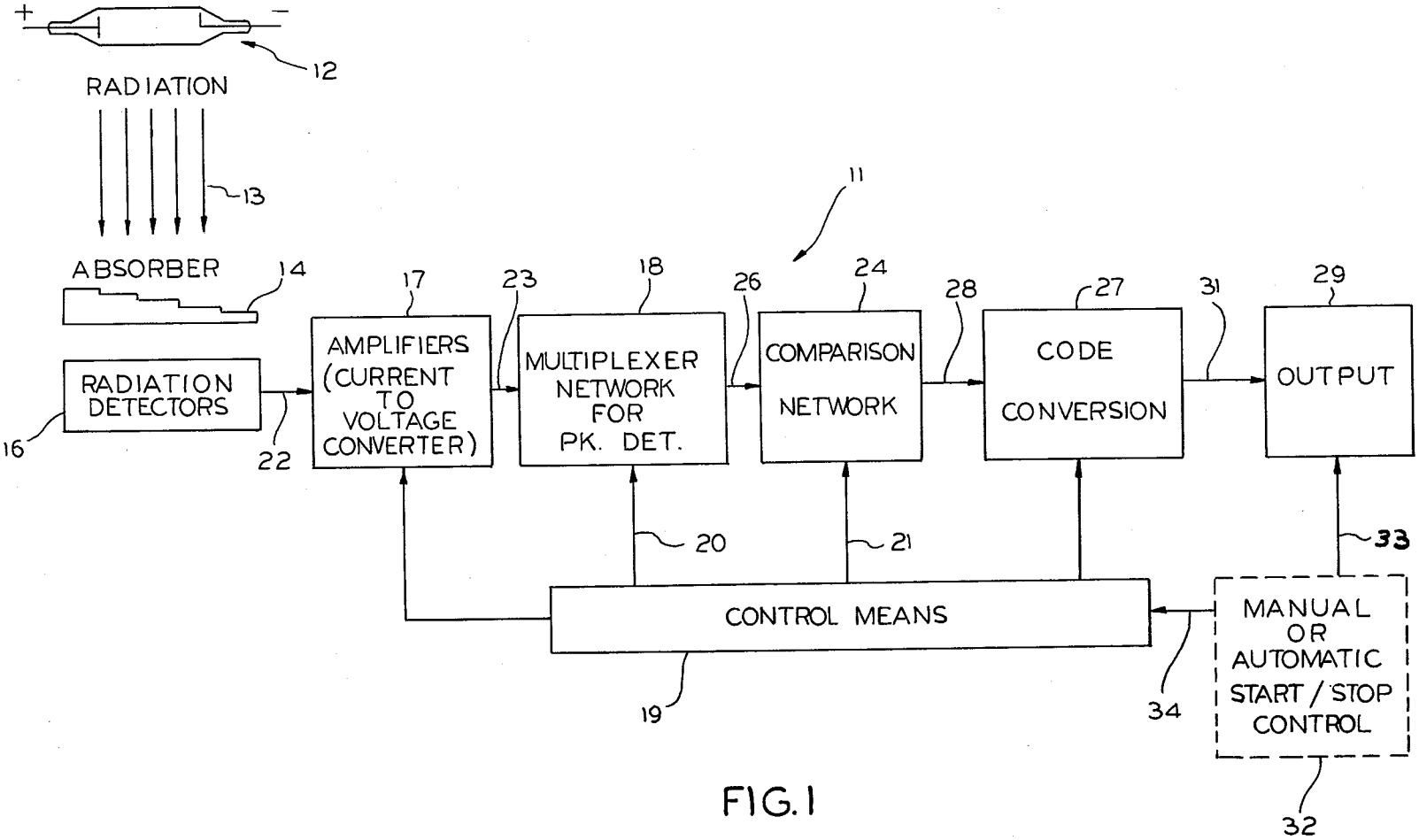
FIG. 1 is a block diagram of a preferred embodiment of radiation energy calibrating system.

The radiation energy measuring equipment 11 shown in FIG. 1 is used in determining the peak kilovoltage input to a radiation source or the maximum energy of the beam derived from the source of radiation, such as x-ray tube 12. The radiation is indicated at 13.

A stepped absorber 14 is located between the radiation source and detector means 16. The stepped absorber 14 need not be any particular material. A convenient absorber used in a preferred embodiment of the invention is copper. The thickness of the absorber is selected by trading off the amount of signal required to properly activate the radiation detectors and subsequent electronic equipment and the accuracy of the reading required for the particular measurement. The thicker the absorber, the more accurate the reading. That is because there are inherent absorbers associated with the radiation source. For example, for a conventional x-ray tube, there are absorbers such as the glass enclosure of the x-ray tube, the window of the x-ray tube housing and the oil in the housing. The amount of absorption varies from x-ray machine to x-ray machine.

The thinnest portion of absorber 14 is chosen so that the amount of absorption inherent to the machine is negligible as compared to the absorption of the absorber; and thus, the accuracy of the measurement is increased as the thickness of thinnest portion increases. However, the signal remaining after absorption must be sufficient to activate the sensing and measuring equipment. When the signal is too small, errors creep into the measurement because of, among other things, the noise level relative to the amplitude of the signal.

The radiation detector means 16 provides a low amplitude current signal as a function of the quantity of the radiation striking it. Means indicated at box 17 are provided for amplifying the signal and converting it to a voltage signal.

Means, such as multiplex network 18 are provided for determining the signal at each of the plurality of radiation detectors used. Thus, the radiation detector means 16 comprises a plurality of radiation detectors, each under a section of different thickness of the stepped absorber 14.

The various voltage signals are read out on a time basis by multiplexer network 18. The timing signal controlling the multiplexer network 18 and the comparison network 24 are received from control means 19 over conductor means 20 and 21 respectively. The radiation detector means is coupled to the amplifiers 17 over conductor means 22 and the output of the amplifiers 17 are coupled to the multiplexer network 18 over conductor means 23.

A reference signal may be provided to a comparison network shown at 24. The standard signal can be an arbitrary one such as that provided by taking a fraction of the output through a step of the absorber where it is just thick enough to compensate for errors due to inherent absorption in the source over a designated kilovoltage range. The output of the multiplexer network 18 is coupled to the comparison network 24 through conductor means 26. The comparison network makes a comparison determination using each of the signals received from the stepped absorber and either a separate reference signal of reference signals obtained from the detectors under the stepped absorber. Hence, the circuitry actually determines the peak signal and multiplexes the peak signal for each step of the absorber into the comparison network where it is compared with the reference. Thus, there actually is one basic comparison network which is sequentially switched through the detectors associated with each of the steps.

The output of the comparison network is shown coupled to a code conversion circuit 27 through coupling means 28. The code conversion unit connected to output 29 through conductor means 31 translates the output of the comparison network into a proper signal for providing the output readout at 29. For example, the code conversion unit linearizes the function and converts the output of the comparison network to a kVp reading. The output at 29 is, for example, a digital readout which automatically provides a reading of the peak kilovoltage or it is a number which can be used with a chart to readily obtain the peak kilovoltage.

The automatic "start" and "stop" control circuit 32, or the manual switches necessary for starting and stopping the circuitry 11 are shown coupled to the output 29 through coupling means 33 and to control means 19 through coupling means 34.

Figure 2:
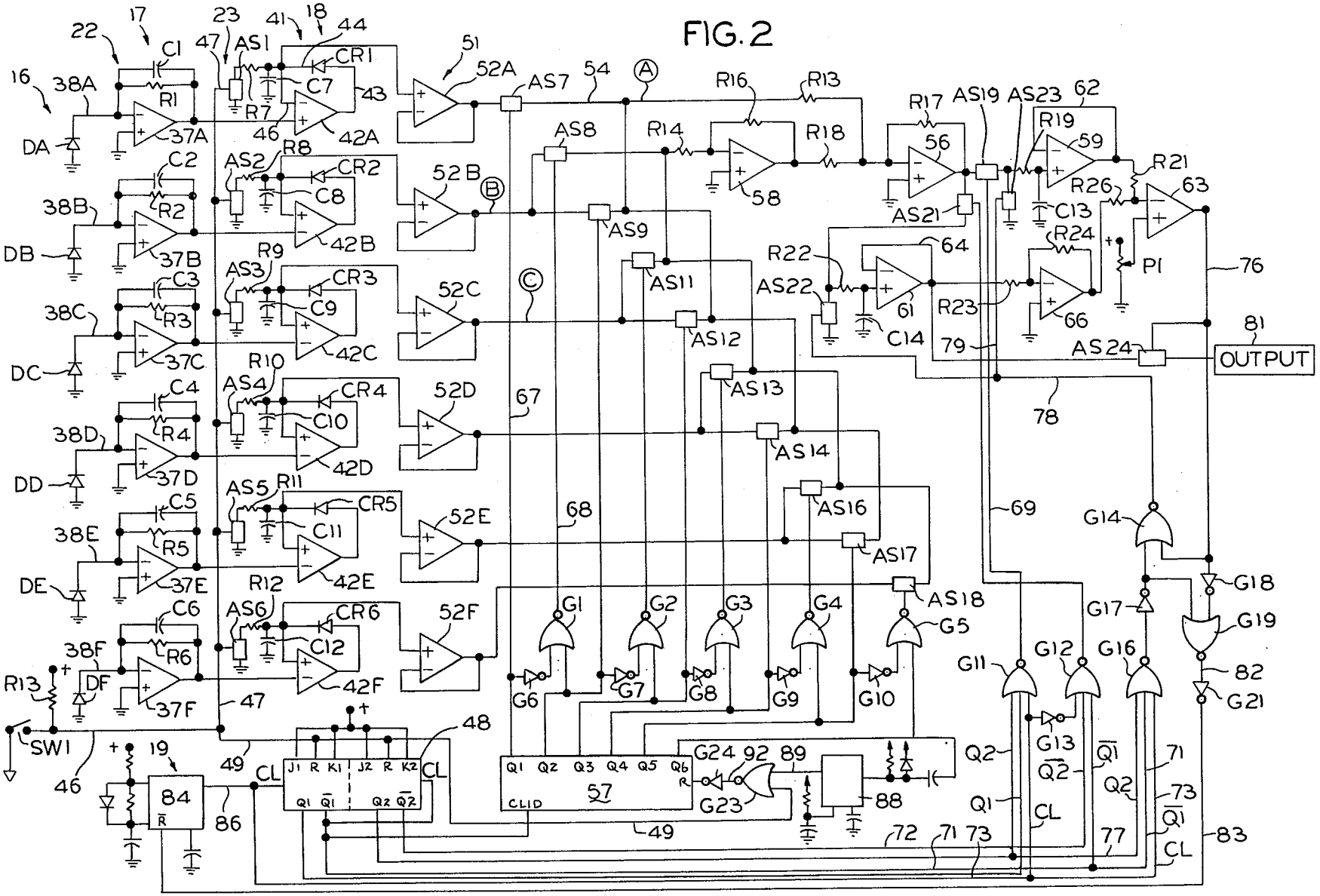
FIG. 2 is a schematic diagram wherein the peak kilovoltage input to the radiation source is determined by detecting the peak intensity from the radiation source and using that information to find the point on a radiation intensity versus filtration curve where it approximates a linear function.

In the schematic form of FIG. 2, the radiation detectors 16 are shown as diodes, such as diodes DA-DF. It should be understood that other types of detectors could be used; for example, ion chambers, photo diodes, or special semi-conductors. The function of the detectors preferably, is to provide an output which bears a monotonic relationship to the intensity of the incoming radiation.

Not shown in FIG. 2 are the steps of the absorber which are in front of each of the diodes. The output of the detectors are coupled to operational amplifiers connected as current to voltage converters, shown generally as amplifiers 17. The diode DA is shown coupled to the inverting input of amplifier 37A over conductor 38A. The conductor 38A connects the cathode of diode DA to the inverting input of amplifier 37A. The anode of diode DA is coupled directly to ground, and the non-inverting input of amplifier 37A is also connected to ground.

Diode DB is shown coupled in the same manner to amplifier 37B and similarly diodes DC through DF are coupled to amplifiers 37C through 37F, respectively. The actual individual conductors coupling the detectors to the amplifiers are shown generally as the conductor means 22 comprising conductors 38A connecting diode DA to amplifier 37A and conductors 38B through 38F connecting diodes DB through DF to amplifiers 37B through 37F, respectively.

Noise suppressor means are provided. More particularly, each of the amplifiers has a feedback circuit comprising a capacitor such as capacitor C1 bridging resistor R1. The bridge circuit of capacitor C1 and resistor R1 is coupled from the output of the current to voltage converting amplifier 37A to the inverting input of that amplifier.

Each of the amplifiers has a similar feedback circuit. For example, amplifier 37B has feedback circuit comprising the bridged network of capacitor C2 and resistor R2.

The input to the amplifers are current signals which vary in amplitude as a function of the radiation intensity striking the detector diode. The greater the quantity of radiation striking the diode the higher the signal is at the output of the converting amplifier.

Means are provided for detecting the peak of the output signal of the detectors. The means are the operational amplifiers 41 connected as peak detectors. For example, the output of amplifier 37A is connected to the non-inverting input of the peak detecting amplifer 42A. The output of peak detecting amplifier 42A is fed back through diode CR1 to the inverting input of amplifier 42A. More particularly, the output of amplifier 42A is coupled to the anode of the diode CR1 through conductor 43. The cathode of diode CR1 is coupled to the inverting input of the amplifier through conductors 44 and 46. It should be understood that the circuits could be coupled with opposite polarities if the connections are consistent. Thus, the polarities are discussed only by way of example.

A capacitor C7 is connected between the junction of conductors 44 and 46 to ground. Also coupled to that junction point is a resistor R7. The other side of the resistor R7 is connected to ground through analog switch AS1. Switch AS1, in a preferred embodiment is a Motorola type MC 14016 switch that is normally open. It closes when a high is put on its control input 47. It is apparent that a current signal into the converters 17 becomes a positive input to the peak detector amplifiers 41.

The output of the peak detector amplifier is stored in capacitor C7. When the input signal becomes less positive, then a signal goes into amplifier 42A, but is not transmitted through diode CR1. At this point the voltage is stored on the capacitor C7. When switch AS1 receives a high signal at its input 47, the resistor R7 is coupled to ground providing a path for discharging capacitor C7. There are various methods for determining the peak measurements obtained from the series of detectors. The method of FIG. 2 is to compare the differences in the peaks obtained from the sequential detectors. A difference in the detected readings that is less than a prescribed small difference provides the means for determining the peak kilovoltage. The small difference in the detected reading at that point indicates an approximately linear portion on a curve of the natural log of intensity versus absorber thickness. The thickness of the absorber step at which this occurs is related to the peak kilovoltage.

At the beginning of the measurement, switch SW1 is operated to the closed position; thus, opening all of the analog switches, such as switches AS1 and AS6. More particularly, when switch SW1 is open, a positive voltage or a high signal is placed on the control inputs of the analog switches AS1 through AS6 simultaneously through resistor R13 and conductors 46 and 47. This causes each of the switches to close and the capacitors C7 through C12 to discharge simultaneously through resistors R7 through R12 and the switches.

The low signal transmitted to the switches AS1 through AS6 when switch SW1 is closed is also transmitted to the control equipment 19 and more particularly to the reset terminals of JK flip-flop circuits 48 through conductors 46 and 49. The JK circuits are shown with the J and K terminals tied to positive voltage and the reset terminals R tied to the junction of conductors 46 and 47 through conductor 49. Thus, closing switch SW1 among other things, opens the switches AS1–AS6 and enables circuits 41 and 48.

The output of the peak detector at the junction point of the diode and the capacitor, such as diode CR1 and capacitor C7, is coupled to buffer amplifiers 51. For example, the output of amplifier 42A is coupled to the non-inverting input of amplifier 52A. The output of buffer amplifier 52A is tied directly to its inverting input. Each of the other detector circuits, which all operate at the same time, are also tied to buffer amplifiers, such as buffer amplifiers 52B through 52F.

Means are provided for comparing the differences between each of the sequential dectectors. More particularly, the output of buffer amplifer 52A is coupled through analog switch AS7, conductor 54, and resistor R13 to the inverting input of a summing operational amplifer 56.

Means are provided for multiplexing each of the outputs derived from each of the detectors to the summing amplifier 56. A counter, such as a commercially available counter MC14017, is shown at 57. It provides signals for operating the analog switches associated with the buffer amplifiers. More particularly, the output of the amplifiers 51 go through a "tree" arrangement to a subtracting network. For example, the output of amplifier 52A is connected through switch AS7, conductor 54 and resistor R13 to the inverting input of amplifier 56. The output of amplifier 52F is connected through switch AS18, the "tree", and resistor R14 to the inverting input of amplifier 58. The output of amplifiers 52B–52E are connected through switches AS8, AS11, AS13, AS16, the "tree" and resistor R14 to amplifier 58. The output of amplifiers 52B–52E are connected through switches AS9, AS12, AS14, AS17, the "tree" and resistor 13 to amplifier 56.

The non-inverting input of amplifiers 56 and 58 are connected directly to ground. The output of the amplifier 58 is connected to its inverting input through resistor R16. The output of amplifier 56 is coupled to its inverting input through resistor R17. The output of amplifier 58 is connected to the the inverting input of amplifier 56 through resistor R18.

The output of amplifier 56 is alternately connected to a pair of storage amplifiers 59 and 61 through analog switches AS19 and AS21, respectively. The other side of switch AS19 is coupled to the non-inverting input of storage amplifier 59 through resistor R19. The junction of resistor R19 and the non-inverting input is coupled to ground through storage capacitor C13. The output of amplifier 59 is coupled to the inverting input of a comparator amplifier 63 through resistor R21.

The other side of analog switch AS21 is connected into the non-inverting input of storage amplifier 61 through resistor R22. Storage capacitor C14 is provided at the junction of resistor R22 and the non-inverting input to operational amplifier 61. The output of amplifier 61 is fed back to its inverting input through conductor 64. The output of amplifier 61 is also fed into the inverting input of an inverter amplifier 66 through resistor R23. The inverter 66 has its non-inverting input coupled directly to ground and its output coupled to its inverrting input through resistor R24. The output of amplifier 66 is also coupled into the inverting input of comparator 63 through summing resistor R26. The non-inverting input of comparator 63 is coupled to a positive reference voltage through the wiper of potentiometer P1. The ends of potentiometer P1 are connected between the positive voltage and ground. Potentiometer P1 sets the error limits of the differences between the compared slopes.

Figure 5:
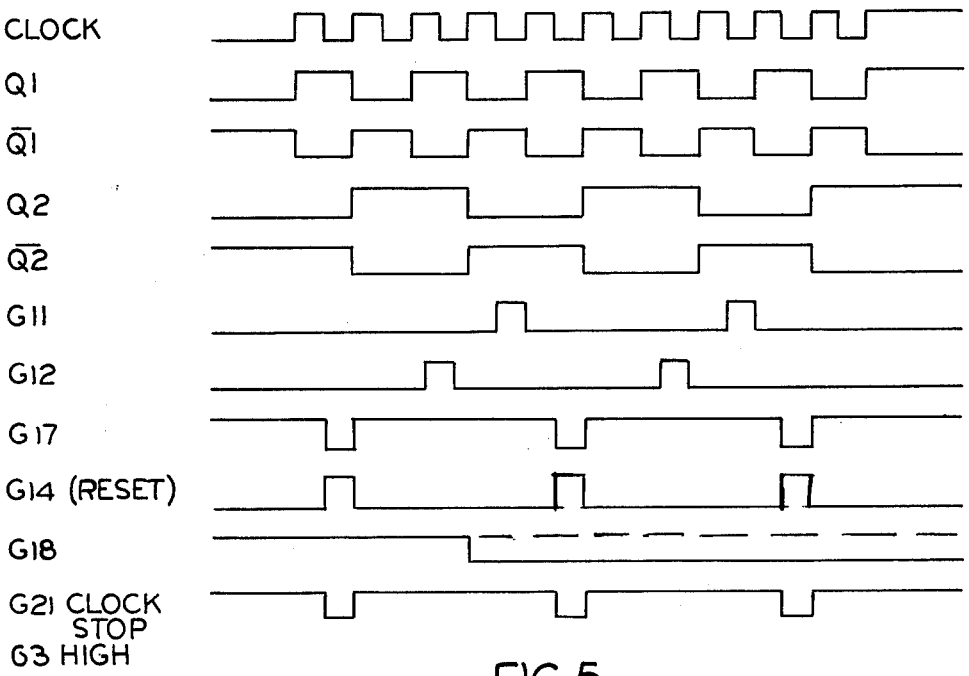
FIG. 5 shows waveforms useful in explaining the operation of the circuitry of FIG. 2.

Means are provided for simultaneously operating two of of the switches AS7 through AS18 sequentially in paired steps. This means is the counter 57, along with two input NOR gates G1, G2, G3, G4 and G5. Associated with each of the NOR gates G1 through G5 are inverter gates G6 through G10, respectively. The counter operating responsive to a signal received from the $\overline{Q1}$ terminal of the combined JK circuits 48 (see FIG. 5) provides sequential high outputs at Q1 through Q6 of circuit 57.

The closing of SW1 enables the counter 57 through gates G23 and G24. An astable 84 also starts at this time, but not because of SW1 directly, but because of the reset line going high via comparator 63. The dual JK flip-flop 48 provides signals Q1 and Q2 synchronous with the clock of astable 84 but twice as long and four times as long, (See FIG. 5) respectively. These signals (clock, Q1, Q2 and their NOT functions) are gated together by gates G11, G12 and G16 in conjunction with inverter gate G13 to provide the timing needed for the various comparisons.

The first slope is determined when signal A, the output of buffer amplifier 52A and signal B, the output of buffer amplifier 52B are presented to the multiplexing and comparator circuitry. This occurs when counter 57 simultaneously turns on switches AS7 and AS8. Signal B is inverted by inverter 58, and added to signal A, the resulting difference, A − B is the output of summing operational amplifier 56.

The result A−B is stored when the signal from gate G12 is high, (see FIG. 5 $\overline{Q1}$ low, $\overline{Q2}$ low) which turns on switch AS19, storing the result on capacitor C14. The rising edge of $\overline{Q1}$ of circuit 48 steps the counter, allowing switches AS8 and AS9 to go on, resulting in a signal, B−C at the output of amplifier 56. The output of gate G11 goes high after this, (see FIG. 5 clock low, $\overline{Q1}$ low and $\overline{Q2}$ low turning on switch AS21) causing the signal B−C to be stored on capacitor C13. The two results, i.e., the slopes A−B and B−C are compared at comparator 63, by taking the difference of these two signals, to see if the difference falls within the given range set by potentiometer P1. If it does, the output of comparator 63 goes high. Responsive to a high at comparator 63, the analog signal from capacitor C14 is presented at the output device 81 via switch AS24, and, also, the clock is stopped.

If the signal differences are not in the range set by potentiometer P1, the output of circuit 63 is a low, which enables the clock to continue, and also resets the capacitors C13 and C14 through switches AS23 and AS24 respectively, to enable further storage.

More particularly, the high of comparator 63 is turned low by inverter G18. When inverter G17 also provides a low, then the output of inverter G21 goes low (Gate G19 goes high, see FIG. 5.) The low signal at the R input of astable 84 stops the clock — all signals cease varying at this time and the output shows the equivalent value of the radiation energy that caused the clock and stepping to stop.

The falling edge of the output of Q6 of circuit 57 triggers monostable circuit 88 to provide a high pulse at its output conductor 90 which causes NOR gate G23 to provide a low pulse at output 92. The low pulse is converted to a high pulse by inverter gate G24 which is attached to the reset input of the counter 57; resetting that counter.

Figures 3, 4:
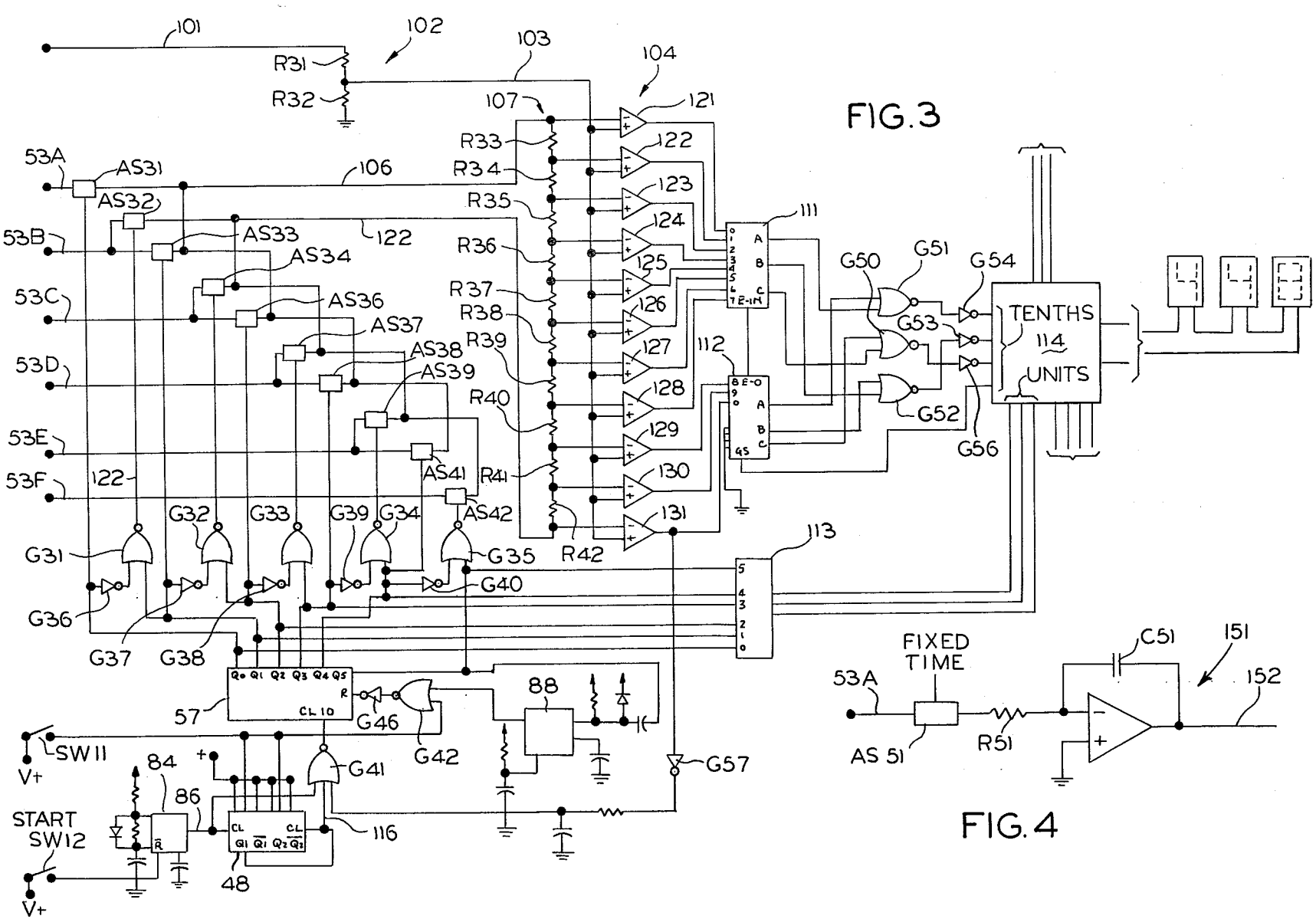
FIG. 3 is a schematic diagram wherein the peak kilovoltage input into the radiation source is determined through the detection of the peak radiation intensities and the use of decade resistance means to compare the detected peak values to standards.
FIG. 4 shows a variation wherein several output peaks of each detector are averaged to determine the peak kilovoltage input to the source.

Another embodiment of the calibration device is shown in FIG. 3. This embodiment features circuitry used after the buffer amplifiers 51 of FIG. 2 and is actually another embodiment of the multiplexing, comparison, code conversion and output networks 18,. 24, 28, 27 and 29 of the block diagram of FIG. 1. In this embodiment the reference is automatically matched to a value on the voltage range between each of the sequentially detected signals. This is accomplished by using a resistor network. That is, each detector behind a step of the absorber produces a signal. That signal is multiplexed and applied to the top of a decade network while the signal output of the next detector is applied to the bottom of the decade network. The signal from each resistor of the decade network is compared in a comparator with the reference signal. When the signals match, then a high output is obtained from one of the comparators.

Means are provided for obtaining the reference signal. The reference signal passes through conductor 101 and a voltage divider 102 comprising resistors R31 and R32 in series. The bottom of resistor R32 is grounded. The junction of resistors R31 and R32 is coupled through conductor 103 to the inverting input of each of a series of operational amplifiers indicated as 104. These amplifiers are connected as comparators and thus the output of these operational amplifiers 104 is a comparison of the attenuated reference signal on conductor 103 and each of the signals applied to the non-inverting inputs of the operational amplifiers from the decade circuit 107.

The buffer amplifiers of FIG. 2 are assumed to be to the left of the schematic of FIG. 3. Thus, amplifier 53A is connected to the conductor 106 through analog switch AS31. Similarly, the output of amplifier 53B is connected through analog switches AS32 and AS33. The output of amplifier 53C is connected through analog switches AS34 and AS36. The output of amplifier 53D is connected through analog switches AS37 and AS38. The output of amplifier 53E is connected through analog switches AS39 and AS41 and the output of amplifier 53F is connected through analog switch AS42.

The outputs of the analog switches are connected through a series resistor network shown generally as 107. In a preferred embodiment network 107 is a decade resistor network. A signal from 53A passes through analog switch AS31, and is attached to the topmost resistor R33 of the series resistor network. The signal from amplifier 53B simultaneously is connected through switch AS32 to the bottommost resistor R42 of the network 107. That same output is subsequently connected through switch AS33 to the topmost resistor R33. The ten resistors are labeled R33 through R42.

The multiplexing is accomplished in a slightly different manner than the multiplexing was accomplished in the circuit of FIG. 2. More particularly, a counter-network 57 is used in conjunction with a group of NOR gates G31, G32, G33, G34 and G35. Associated with each of the NOR gates is an inverter gate labeled G36 through G40. There is also associated with the counter on one of the two JK flip-flops 48, a monostable circuit 88 and an astable circuit 84. Coupling the flip-flop circuit to the counter circuit is a NOR gate G41. A reset switch SW11 is shown coupled to another NOR gate G42. An inverter gate G43 couples the output of gate G42 G42 to the reset input of counter 57.

The outputs of the comparator amplifiers 104 are shown connected to a pair of priority encoders 111 and 112. These are commercially available encoders wherein the highest digit input produces a binary output. In a preferred embodiment, Motorola circuits MC14532 are used. Two priority encoders are used because there are ten inputs into the priority encoders and the commercially available circuitry only has seven inputs. Thus, three inputs are used on the second encoder.

Another encoder, 113, of the same type is used in conjunction with the multiplexing NOR gates. Its output is fed into a converter board circuit 114 to produce an output that is to be shown as an LED type display of the kilovoltage.

The binary output from the encoders 111 and 112 is translated through a plurality of NOR gates G50, G51 and G52 and inverter gates G53, G54, and G56 to provide "tenths" at the converter board. The unit input is provided by the binary output of circuit 113.

In practice, switch 12 is closed, starting the astable circuit 84 oscillating, producing clock waveforms (shown in FIG. 6) on conductor 86. The dual JK flip-flop 48 is connected to produce a waveform at output Q1, that changes states on every rising edge of the incoming clock pulse.

The input to the decade counter 57 is composed of three signals, that are "anded" (that is, all inputs have to be low to produce a high output) together at gate G41. The signals are:

1. The clock signal
2. The output of Q1 of circuit 48
3. The inverted output of the last comparator 131

If all of these signals are low, the decade counter will receive a pulse, causing the output to move from $Qn$ to $Qn+1$.

The logic gates G31 to G40 act as a multiplexing or routing network, allowing two signals at a time to be presented—one to the upper and the other to the lower end of the resistor network 107. There are two possible cases that can occur.

1. If the reference signal is between the upper and lower voltages on the network, then the last comparator 131 will output a low, and, when inverted by gate G57, will stop the pulses going into the decade counter, by acting as an inhibit on gate G41.

(The actual point where the detected signal is, in respect to the 10 resistors, is displayed by the output of the priority encoders and associated gates, G51 - G56. That is, if the reference signal is equal to the detected signal on R39 then it will be larger than the voltage at the connection of R38 and R39, but smaller than the voltage at the junction of R39 and R40. Hence, the output of comparators 121 through 127 will output a high voltage. The priority encoders are arranged such that the the highest voltage input will be displayed in binary code.)

2. If the signal doesn't fall in the entire decade range, then the output of comparator 131 will be high, and the pulses, which step the decade counter, will continue incrementing the counter to the next state, thereby allowing two more voltages to be used in the comparison to the reference. This process will continue until case 1 occurs.

Figure 6:
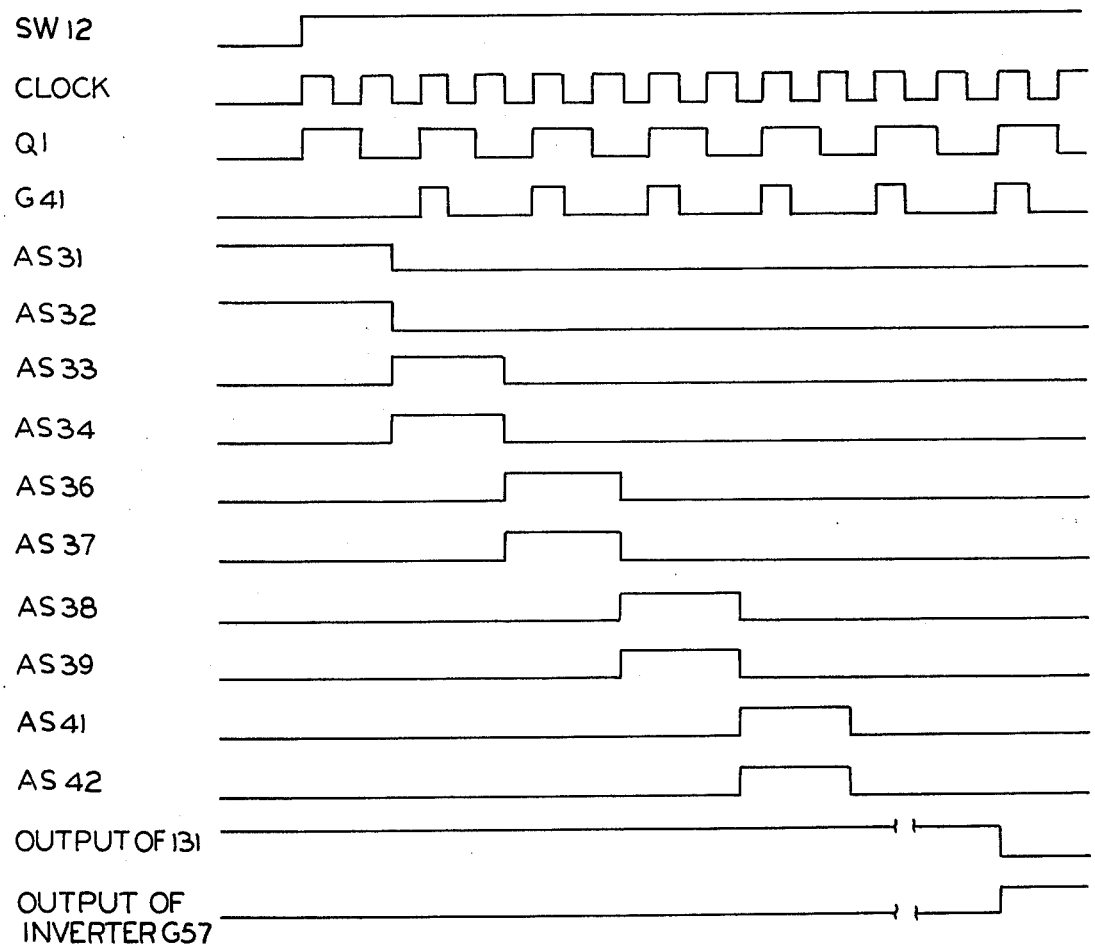
FIG. 6 shows waveforms useful in explaining the operation of the circuitry of FIG. 3.

The waveform diagram of FIG. 6 illustrates the multiplexing operation of the circuit of FIG. 3.

When switch SW12 is closed, a high is placed on $\overline{R}$ of circuit 84 starting the clock. Each rising pulse edge of the clock signal varies the Q1 signal of circuit 48. When the clock signal, Q1 signal and the signal of G57 are all simultaneously low then gate G41 produces a high signal. The rising edges of the high pulse of Gate G411 closes successive pairs of switches AS31- AS31 - AS34, AS36 - AS39, and AS41 through AS42. When the output of comparator 131 is low and hence the output of Gate 57 is high Gate G41 is inhibited.

It should be noted that in both the circuits of FIGS. 2 and 3, the monostable circuit 88 coupled to the counter 57 converts the counter to a ring counter. It should be noted in FIG. 3 that the high from Q5 of the counter causes the monostable to produce a resetting high at the input of gate G42 and a high at the reset input of the counter.

Manual reset is provided by normally open switch SW11. When switch SW11 is open, a low is placed on the input of G42. Since the normal output of the monostable circuit 88 is low, the output of gate 42 is then high. Inverter G45 then produces a low at the reset input, having no efffect. When switch SW11 is closed, a high is delivered to gate G42. The resultant low output is inverted and delivered to reset the counter.

FIG. 4 shows another embodiment wherein the detected peaks are summed and the signal average is determined.

For example, the signals from the peak detector 42A and a buffer amplifier 52A of FIG. 2 is delivered over conductor 53A to analog switch AS51. The output of the switch AS51 is delivered to an integrator 151 through the resistor R51. The feedback capacitor is connected between the output 152 and the inverting input. The non-inverting input is grounded. The switch AS51 is is periodically operated in synchronism with input voltage voltage applied to the x-ray tube for fixed periods of time to enable a plurality of peaks to be summed. A similar integrating circuit is provided at the output at each of the baffle amplifiers. The outputs of the integrators are multiplexed and compared as in either of the previously described circuits.

In practice, a given voltage from the peak detector is presented to the integrator for a fixed time period. Then the peak detector is reset and detects another peak and the process is repeated. An advantage of the integration is the elimination of periodic noise.

Thus, the particular exemplary means for determining the KV peak have been described. As shown and described, the detected peak is used to obtain the calibration of the peak kilovoltage applied to the radiation source.

The foregoing description and drawings merely explain and illustrate the invention and the invention is not limited thereto, except insofar as the appended claims are so limited, as those skilled in the art have the disclosure before them will be able to make modifications and variations therein, without departing from the scope of the invention.

We claim:

1. A radiation energy calibrating device for determining the peak voltage applied to a source of radiation where the source is subjected to a varying input voltage, said calibrating device comprising:

radiation detector means operated responsive to the radiation output of the source for providing electrical signals that are direct functions of the radiation intensity, calibrated absorber means between said source and said detector means, means for detecting the peak electrical signals provided by said radiation detector means;

means for converting the peak electrical signals to the kv peak input to the source, and wherein said means for converting the peak electrical signals to the kv peak input to the source comprises means for determining the minimum absorber thickness through which the transmitted radiation spectrum is effectively monoenergetic and corresponds to the peak voltage applied.

2. A radiation energy calibrating device for determining the peak voltage applied to a source of radiation;

said calibrating device comprising, a plurality of absorber means for absorbing predetermined amounts of radiation;

radiation detector means operated responsive to radiation from a source passing through said absorber means to provide electrical signals that are a function of the intensity of the radiation passing through the absorber means, peak detector means operated responsive to said electrical signals to determine the peak signals, comparator means for comparing the peak signals to a standard signal to provide an indication of the relative amplitude of the detected peak signal and the standard signal, and means for selecting one of said absorber means of said plurality of absorber means by determining the radiation intensity transmitted through the absorber is a specified percentage of the standard signal, and means for converting the thickness of the one of said absorber means to the peak kilovoltage applied.

3. The radiation energy calibrating device of claim 2 wherein said absorber means comprises a step absorber and wherein radiation detector means are individually located at a plurality of said steps to thereby provide a plurality of electrical signals.

4. The radiation energy calibrating device of claim 3, wherein routing means are provided for comparing each of said plurality of electrical signals with said standard signal.

5. The radiation energy calibrating device of claim 4, wherein said standard signal is derived from a selected step of said absorber means.

6. The radiation energy calibrating device of claim 4, wherein said standard signal is derived from a plurality of selected steps of said absorber.

7. The radiation energy calibrating device of claim 4, wherein said standard signal is derived from separate absorber means.

8. The radiation energy calibrating device of claim 5, wherein resistor network means are provided, said resistor network means comprising a plurality of resistors, said routing means applying the signals from sequential pairs of said peak detector means to the top and bottom of said resistor network means, respectively.

9. The radiation energy calibrating means of claim 1 wherein said slope determining means comprises calibrated absorber means inserted between said radiation source and said radiation detector means, said absorber means comprising a plurality of steps of increasing thickness sequentially arranged, said absorber means being fabricated from copper, the thinnest of said steps being more than 2mm, individual radiation detectors at each said plurality of steps, means for subtracting the outputs of said sequentially arranged individual detectors, and means for comparing the differences to determine when the differences are within certain prescribed limits to thereby ascertain that the curve is linear.

10. The radiation energy calibrating device of claim 1 wherein said means for converting the peak signals comprises means for signal averaging a plurality of individually detected peak electrical signals.

11. The method of determining the actual kv peak input to a radiation source when a varying voltage is applied to the source, said method comprising the steps of:

a. absorbing given fractions of the radiation energy from the source,
b. detecting the radiation not absorbed,
c. converting the detected radiation to electrical signals,
d. detecting the peak electrical signals, and
e. processing the detected peak electrical signals to arrive at the kVp by determining when the slope of the natural logarithm of the intensity versus the absorber thickness curve is approximately linear.

12. The method of detecting the actual kVp input to a radiation source when a varying voltage is applied to the source, said method comprising the steps of:

a. placing an absorber for absorbing predetermined amounts of radiation in position in front of the radiation source,
b. detecting the radiation passing through the absorber,
c. converting the detected radiation to electrical signals,
d. detecting the peak electrical signals,
e. processing the detected peak electrical signals to determine a predefined characteristic of the attenuation curve, and
f. matching the predefined characteristic of the attenuation curve so determined to the same characteristic of one of a set of attenuation curves obtained using the absorber between a radiation source of known peak voltage and the equipment for detecting the radiation herein to thereby obtain the input kVp.

* * * * *